US011273955B2

(12) United States Patent
Sostmann

(10) Patent No.: US 11,273,955 B2
(45) Date of Patent: Mar. 15, 2022

(54) STACKABLE CONTAINER

(71) Applicant: Georg Utz Holding AG, Bremgarten (CH)

(72) Inventor: Rüdiger Sostmann, Lingen (DE)

(73) Assignee: GEORG UTZ HOLDING AG, Bremgarten (CH)

( * ) Notice: Subject to any disclaimer, the term of this patent is extended or adjusted under 35 U.S.C. 154(b) by 0 days.

(21) Appl. No.: 17/053,665

(22) PCT Filed: Apr. 11, 2019

(86) PCT No.: PCT/IB2019/052983

§ 371 (c)(1),
(2) Date: Nov. 6, 2020

(87) PCT Pub. No.: WO2019/215521

PCT Pub. Date: Nov. 14, 2019

(65) Prior Publication Data

US 2021/0229863 A1 Jul. 29, 2021

(30) Foreign Application Priority Data

May 8, 2018 (CH) ..... 000574/18

(51) Int. Cl.
*B65D 21/02* (2006.01)
*B65D 81/26* (2006.01)

(52) U.S. Cl.
CPC ..... *B65D 21/0213* (2013.01); *B65D 21/0209* (2013.01); *B65D 81/261* (2013.01)

(58) Field of Classification Search
CPC .. B65D 21/0213; B65D 81/261; B65D 85/34; B65D 81/262; B65D 21/0209
(Continued)

(56) References Cited

U.S. PATENT DOCUMENTS 2,859,122 A * 11/1958 Maturi ..... B65D 81/261 426/232
4,386,700 A 6/1983 Deaton
(Continued)

FOREIGN PATENT DOCUMENTS

BE 1011310 7/1999
DE 297 02 766 6/1997
(Continued)

OTHER PUBLICATIONS

International Search Report dated Jul. 16, 2019 by the European Patent Office in International Application PCT/IB2019/052983.

*Primary Examiner* — Rafael A Ortiz
*Assistant Examiner* — Sanjidul Islam
(74) *Attorney, Agent, or Firm* — Henry M. Feiereisen LLC

(57) ABSTRACT

A stackable container includes a step-shaped edge at upper ends of side walls and, on the outer side of the side walls, a projection resting on the step-shaped edge. Openings at lower edges of the side walls open into a collecting channel which extends along the base and is connected in one piece with the base and which collects small quantities of liquids passing through the openings. The projection covers the collecting channel and, together with the outer wall of the collecting channel and the step-shaped edge of the container located therebeiow, forms a free space, into which larger quantities of liquids can pass and flow into the lower container. Extinguishing water, sprayed over the stack of containers in the event of a fire, can thus pass from the upper container into the lower containers of the stack and extinguish a fire in a lower region of the stack.

6 Claims, 5 Drawing Sheets

(58) Field of Classification Search
USPC ..... 206/509, 423; 137/312
See application file for complete search history.

(56) References Cited

U.S. PATENT DOCUMENTS 4,498,584 A * 2/1985 Newbury ..... A01K 63/02
206/504
4,534,466 A * 8/1985 Wood ..... B65D 21/0233
206/518

FOREIGN PATENT DOCUMENTS

| | | |
|---|---|---|
| FR | 2 681 048 | 3/1993 |
| GB | 951746 | 3/1964 |

* cited by examiner

STACKABLE CONTAINER

CROSS-REFERENCES TO RELATED APPLICATIONS

This application is the U.S. National Stage of International Application No. PCT/IB2019/052983, filed Apr. 11, 2019, which designated the United States and has been published as International Publication No. WO 2019/215521 A1 and which claims the priority of Swiss Patent Application, Serial No. 000574/18, filed May 8, 2018, pursuant to 35 U.S.C. 119(a)-(d).

TECHNICAL FIELD

The invention relates to a stackable container for transporting and storing goods, and in particular to such a container having openings for the outflow of liquids from the container interior.

PRIOR ART

One such container is known for example from GB951746. Said document discloses an injection-moulded container which is produced in one piece and which has, in the base, reinforcing ribs and a number of outflow openings distributed over the base area. At the upper edge of the side walls, the container has a step-shaped and outwardly curved contour which enables identical containers to be stacked.

U.S. Pat. No. 4,386,700 discloses a stackable container for transporting goods, such as fish for example, which has outflow openings for removing liquid from the container. The outflow openings of a container located above in a stack open into an outwardly inclined channel in the upper edge of a container located therebelow in the stack. Liquid that has flowed out is thus prevented from passing into the lower container, and instead is directed outwards.

DESCRIPTION OF HE INVENTION

The problem addressed by the present invention is that of providing a stackable container, from which liquids located on the base can flow out, On the one hand, small liquids that have flowed out from goods should be able to flow away from the base, wherein said small quantities should be collected and should not pass into the lower container of the stack. On the other hand, large quantities of extinguishing water, which are sprayed onto the containers in the event of a fire, should be able to reach also the lower containers in the stack.

This problem is solved according to the invention by a stackable container as described hereinafter.

A stackable container comprises a base and side walls extending vertically upwards from the base, the upper ends of the side walls being designed with step-shaped edges. Another container can be placed onto the step-shaped edges, thereby forming a stack of identically shaped containers.

According to the invention, the container has, on at least two opposite side walls, a plurality of through-openings which are distributed along the lower ends of the side walls that bear against the base. The openings open on the outer side of said side walls into a collecting channel, which is formed in one piece with the base of the container and extends along the outer sides of the base. The outer wall of the collecting channel extends above the height of the vertical extension of the openings on the side walls of the container.

Additionally, the at least two opposite side walls of the container each have, on the outer side thereof, an outwardly directed projection which extends outwards from the side wall over the collecting channel and projects beyond the lateral extension of the collecting channel and has a horizontally extending face at its lower end.

In addition, the vertical face of the step-shaped edge of each side wall of the container extends upwards in each case outside of the lateral extension of the collecting channel and ends in a horizontal face at its uppermost end.

In addition, the position and the lateral extension of the horizontal face at the lower end of the projection on the side walls at least overlap with the position and the lateral extension of the uppermost, horizontal face of the step-shaped edges of the side walls.

The invention makes it possible that small quantities of liquids that inadvertently flow out from goods in the container, such as for example from a broken bottle or from torn packaging, can flow off from the base surface of the container through the openings at the lower edge of the side walls and do not unnecessarily wet the rest of the goods. Such small quantities flow outwards through the openings and into the collecting channel formed at the base, which collecting channel extends along the outer edge of the base and the outer edge of which extends upwards above the region of the openings. Small quantities of liquids that have flowed off therefore remain trapped in the channel, They do not pass fully to the outside, and the outer faces of the container and the contents of a container located therebelow in a stack are not soiled.

The projection according to the invention on the outer sides of the side walls forms in each case a type of roof which covers the collecting channel and extends downwards outside of the outer edge of the collecting channel and ends there in a horizontal face. The step-shaped edge of the upper ends of the side walls likewise in each case forms a horizontal face at the uppermost end thereof. The horizontal faces of the projection and of the step-shaped edge of the side walls and the tailoring thereof to one another in terms of their lateral extension ensure that the container according to the invention can be stacked. To this end, the lateral extensions of the two horizontal faces overlap at least partially. This makes it possible that a container according to the invention can be stacked on a container located therebelow in that the lower, horizontal face of the projection of the side walls can be placed onto the uppermost, horizontal face of the step-shaped edge of the side walls of a container located therebelow, The roof-like projection of an upper container in a stack of containers, and which rests on the step-shaped edge of the container located therebelow, additionally forms, together with the collecting channel and the step-shaped edge, a space into which liquids can flow from the collecting channel if the latter is overfilled. A free space exists between the vertical face of the step-shaped edges of the side walls and the outer wall of the collecting channel, so that liquids which pass over the edge of the collecting channel flow downwards through said free space into the container located therebelow.

The step-shaped design, according to the invention, of the edges of the side walls together with the outwardly directed projection on the side walls thus also offers possible fire protection for stacked containers according to the invention. If, as a result of a fire alarm, extinguishing liquid is sprayed into a warehouse containing stacked containers according to the invention, the extinguishing liquid pass through the outflow openings on the side walls into the collecting channel at the base of the container. Since usually relatively large quantities of water or extinguishing liquid are involved, this passes over the upper edge of the collecting channel into the free space between the collecting channel and the projection and between the step-shaped edge and the outer wall of the channel into the lower container. If a plurality of containers are stacked on top of one another, extinguishing liquid can thus reach the interior of the entire stack. The spread of a fire can thus be prevented or delayed also in the lower containers of the stack.

The invention advantageously requires that, when two containers are stacked, the lower outer face of the collecting channel does not come into contact with the step-shaped edge of the lower container. In other words, the lower outer face of the collecting channel extends beyond the lower, horizontal face of the step-shaped edge of a lower container. The stacking is based solely on the lower, horizontal face of the projection bearing against the uppermost, horizontal face of the step-shaped edge of the side walls.

In one embodiment of the invention, recesses are additionally arranged at the edge of the base in line with the openings for the outflow of liquid from the base of the container, which recesses likewise open into the collecting channel. This additionally facilitates the outflow of liquid from the container.

The openings are arranged along the lower edge of two opposite side walls or circumferentially along all side wails, the collecting channel extending along the two relevant side walls or circumferentially along all side walls.

Further advantages of the invention follow from the dependent claims and from the following description, in which the invention will be explained in greater detail on the basis of an exemplary embodiment shown in the schematic drawings.

BRIEF DESCRIPTION OF THE FIGURES

In the figures, the same reference signs have been used in each case for the same elements, and initial explanations relate to all figures unless expressly stated otherwise.

Exemplary Embodiments of the Invention

Figure 1:
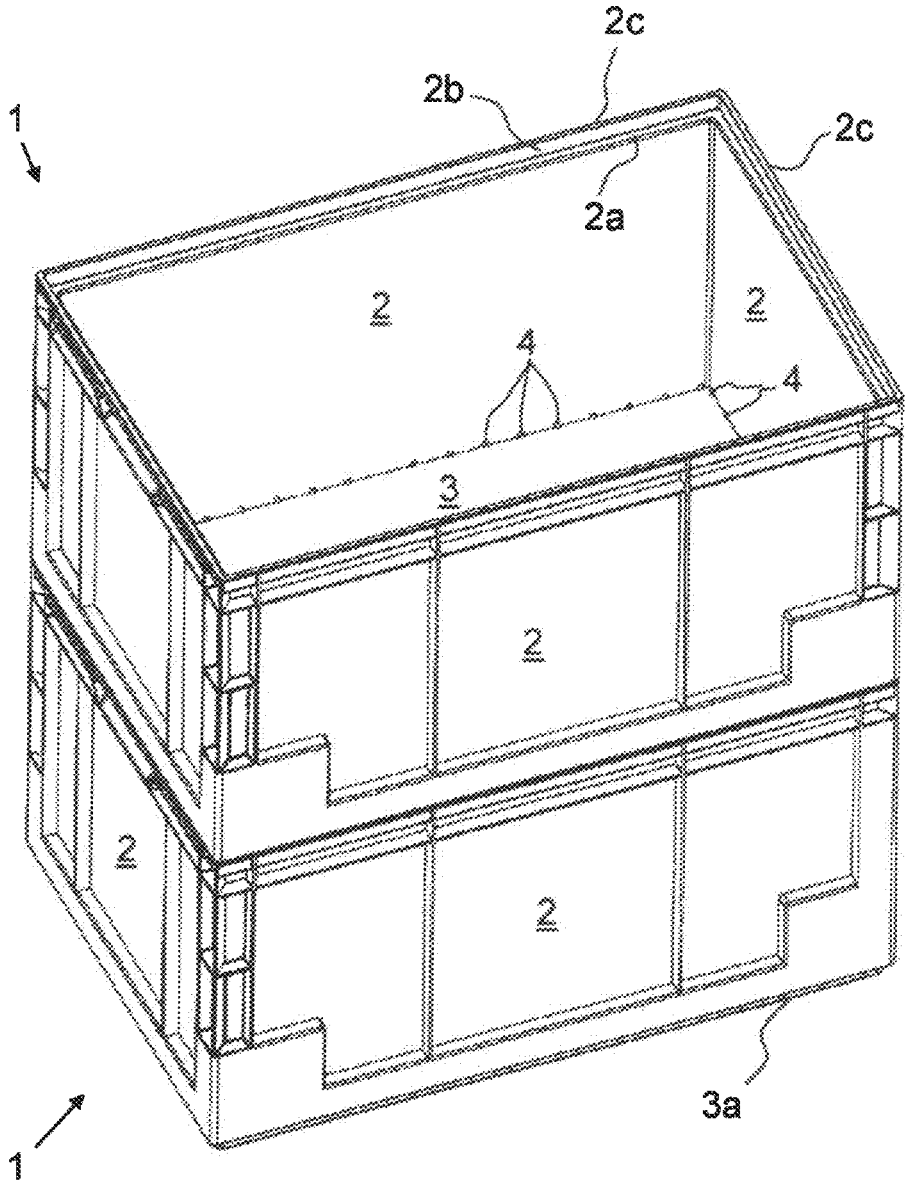
FIG. 1 shows a perspective view of a stack of two containers according to the invention.

FIG. 1 shows a stack of two containers 1 according to the invention, comprising four vertical side walls 2 which surround a rectangular base 3. The outer lower base surface is denoted by 3*a* and will be explained in greater detail in connection with the following figures.

The side walls 2 each have at their upper ends of the container 1, which is open at the top, a step-shaped edge having a first, lower horizontal face 2*a*, a vertical face 2*b*, and a second, upper horizontal face 2*c* which forms the uppermost end of the edge.

At the lower edge of the side walls 2, openings 4 which pass through the side wails are distributed along the length thereof. The base 3 includes recesses 4*b* which are arranged in line with the through-openings along edges of the base and which are configured to open into a collecting channel 3*d*.

Figure 2:
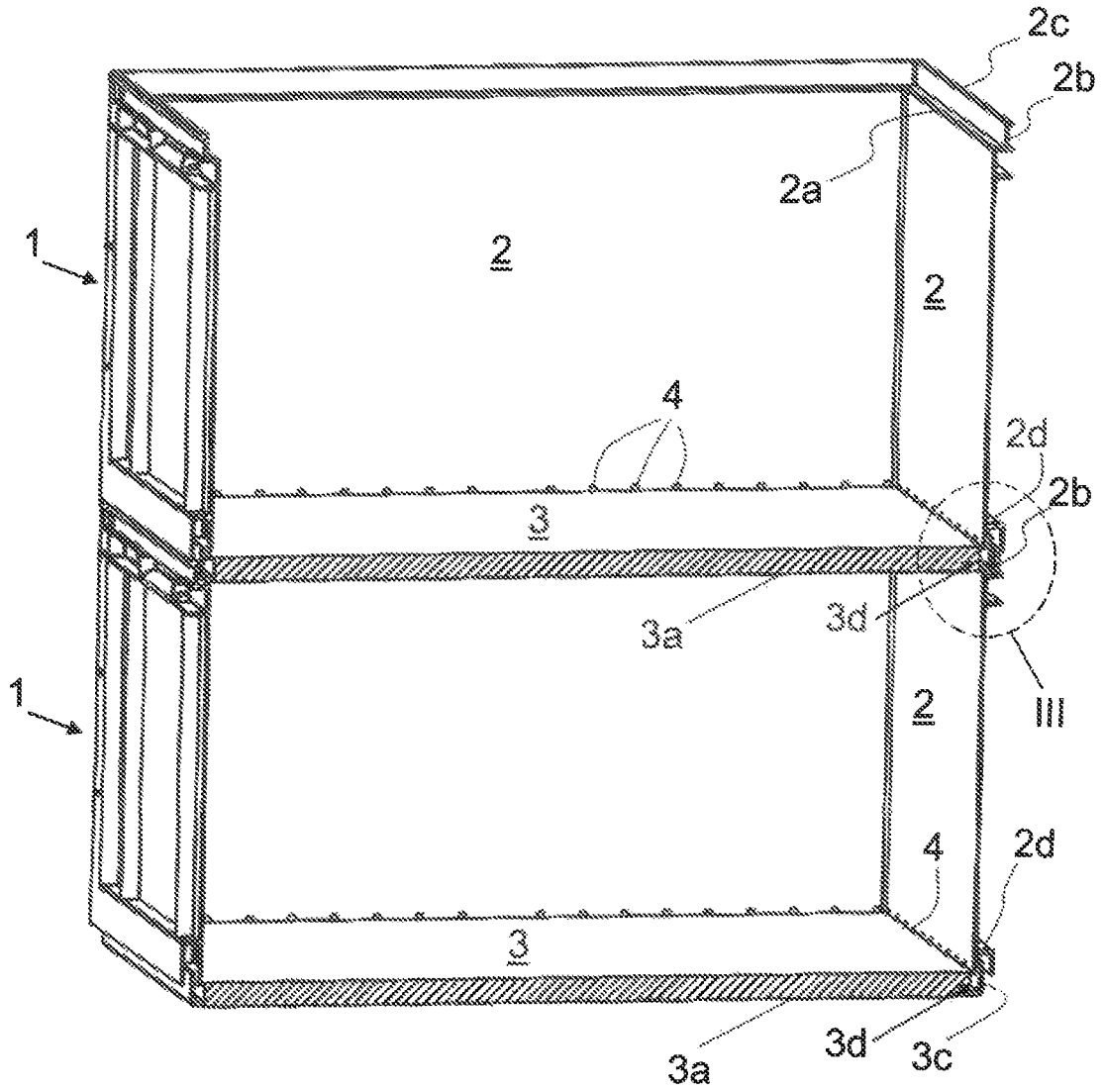
FIG. 2 shows a vertical cross-sectional view of the two stacked containers of FIG. 1 and in particular the design according to the invention of the lower part of the upper container interacting with the upper edge of the lower container.

FIG. 2 shows the stack of containers 1 from FIG. 1 in cross-section. The step-shaped design of the upper edge of the side wall 2 is shown on the upper container 1. An outwardly directed projection 2*d* is arranged in the lower region of the side wall 2. The collecting channel 3*d* is integrated with the base 3 of the container 1. On the lower container 1, it is possible to see how the projection 2*d* projects beyond the outer wall 3*c* of the collecting channel 3*d* and covers the latter.

The stacking of the upper container 1 on the lower container 1 is made possible by means of a horizontal face on the projection 2*d* and the upper horizontal face 2*c* of the step-shaped edge of the side wall. This will be explained in the detail of area III, which is shown on an enlarged scale in FIG. 3.

Figure 3:
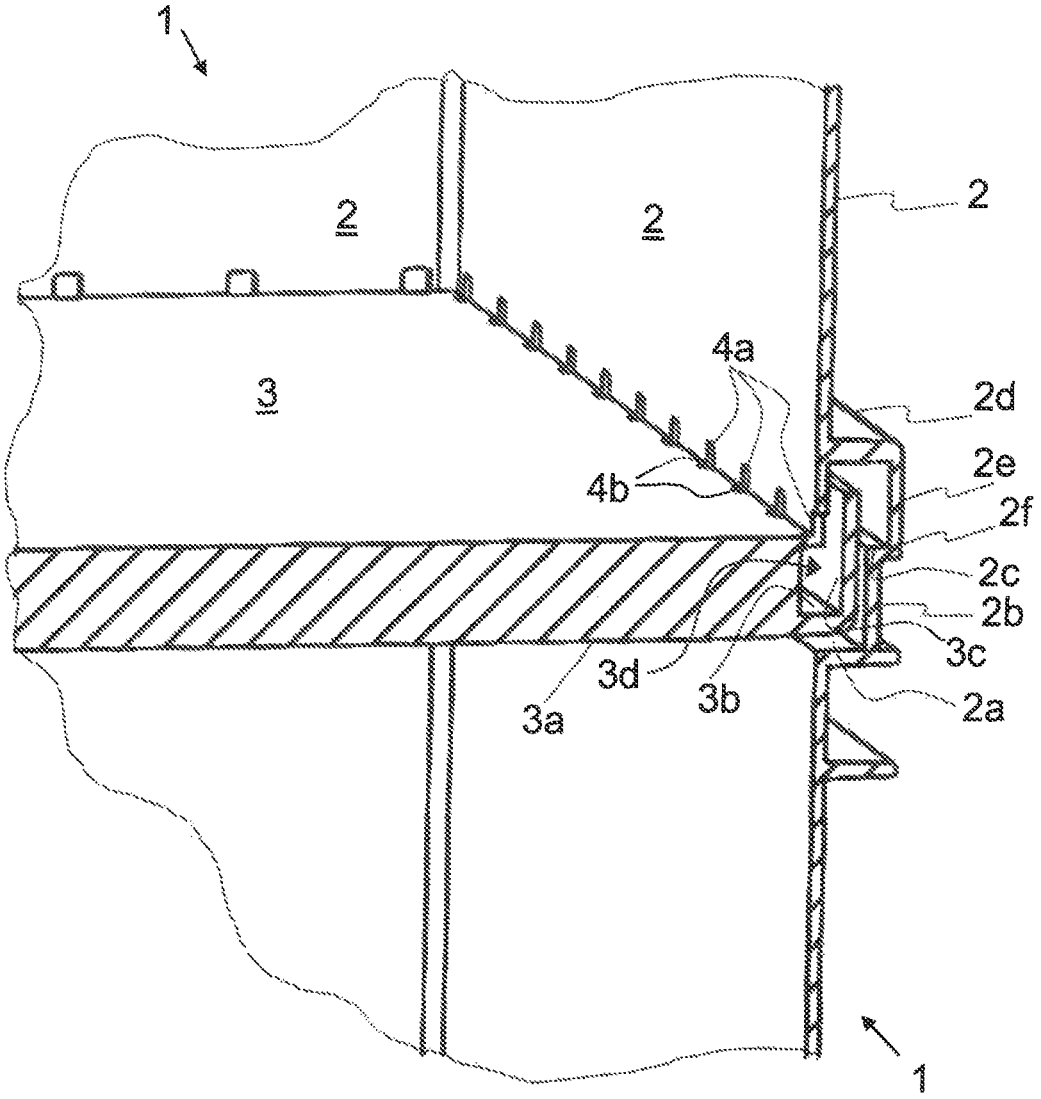
FIG. 3 shows a detail view, indicated by III in FIG. 2, of the lower edge of the upper container interacting with the upper edge of the lower container.

The detail view in FIG. 3 shows the base 3 of an upper container with a lower base plane 3*a* and two of the side walls 2 with openings 4 along the lower edge of the side wails 2. In this exemplary embodiment, the openings 4 extend not only in the side wall 2 but also over part of the base 3 via the recesses 4*b*.

Figure 4:
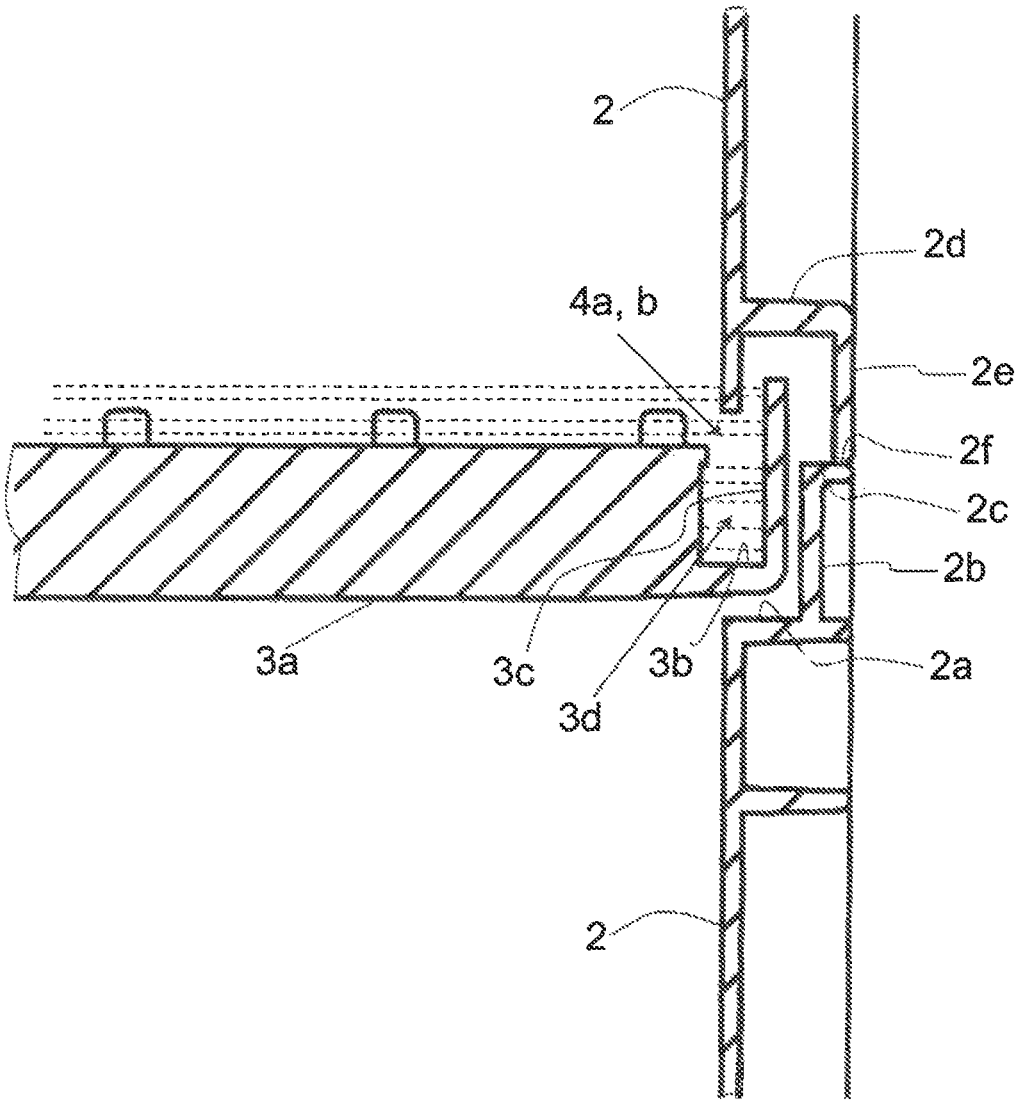
FIG. 4 shows the detail of FIG. 3 in a cross-sectional view with a small quantity of liquids which pass into the collecting channel.

At the lower plane 3*a* of the base 3, the collecting channel 3*d* is integrated in one piece with the base 3. Said collecting channel 3*d* is formed by an outwardly projecting overhang 3*b* and a vertical outer wall 3*c* which extends upwards from the overhang 3*b*. The wall 3*c* advantageously extends beyond the plane of the upper end of the openings 4, so that liquid from the openings is retained in the collecting channel 3*d*. This is shown in FIG. 4. The collecting channel 3*d* extends in its length along all sides of the base 3 on which openings 4 are present.

A roof-like projection is arranged on the outer side of the side wall 2 and extends in the lower region of the side wall 2, and in this exemplary embodiment is formed by an outwardly directed face 2*d* and a wall 2*e* extending downwards from the end of the face 2*d*. The shape of the projection as a whole can be arbitrary. In this example, it has a right-angled shape. However, it may be curved or may slope downwards. What is essential for the projection is that the lower end 2*e* thereof has a horizontal end face 2*f*.

The end face 2*f* rests on a horizontal face 2*c* of the step-shaped edge of the side wall 2 of the lower container 1. The step-shaped edge is formed by a first, lower horizontal face 2*a*, a vertical wall 2*b* extending upwards therefrom, and the second, upper horizontal face 2*c*. The horizontal face 2*f* of the projection and the horizontal face 2*c* of the edge ensure that the containers 1 according to the invention can be stacked. To this end, the lateral position thereof relative to the side wall 2 and the lateral extensions thereof must at least overlap.

Figure 5:
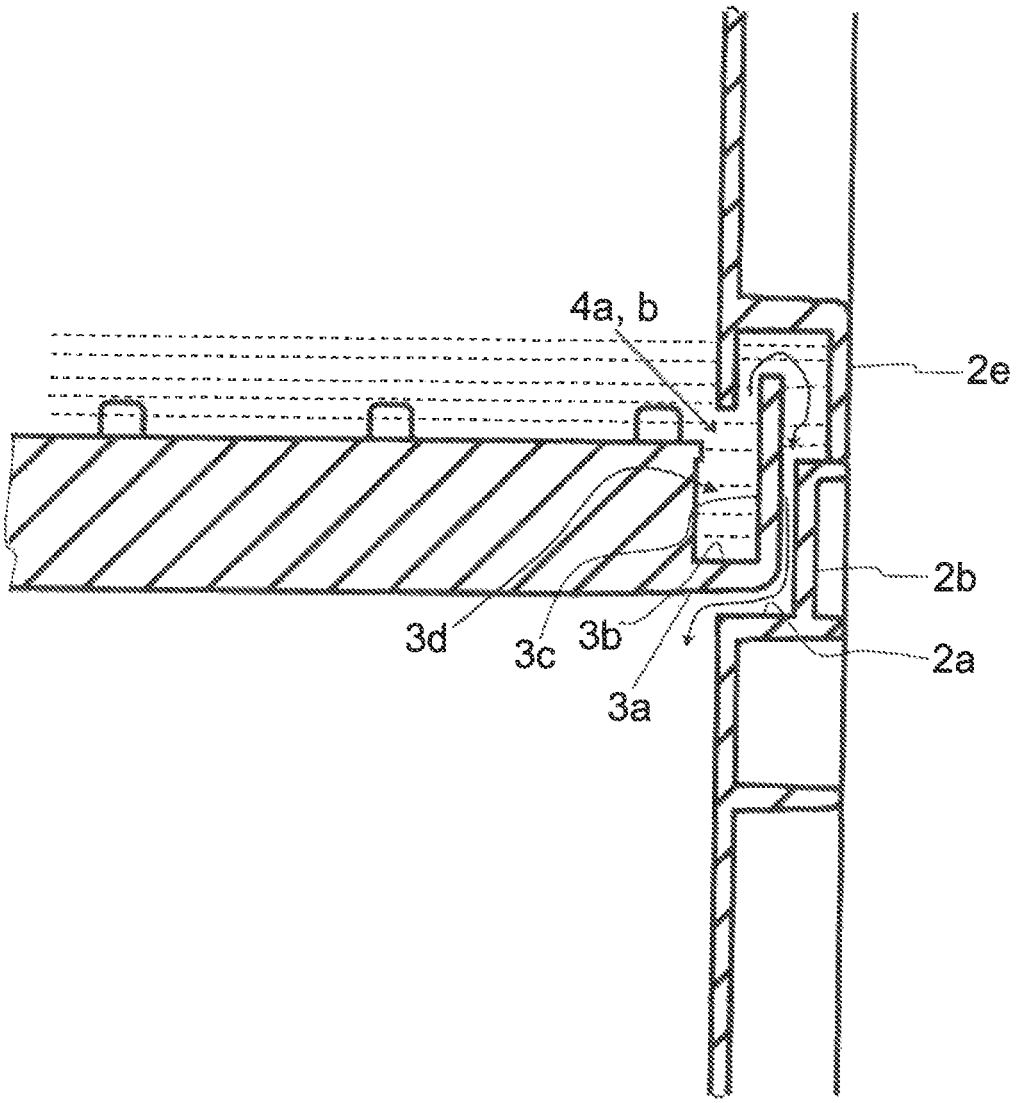
FIG. 5 shows the detail of FIG. 3 in a cross-sectional view as in FIG. 4 with a large quantity of extinguishing liquids which pass over the collecting channel into the lower container of the stack.

At the same time, the projection 2*d*, 2*e* together with the step-shaped edge 2*a, b, c* and the collecting channel 3*d* form a free space, through which liquids can flow into the lower container, as shown by the arrows in FIG. 5. This is particularly the case when larger quantities of liquid, as in the case of extinguishing a fire, pass from the upper container, through the openings 4, into the collecting channel 3*d*, but flood the latter and pass over the wall 3*c*. The extinguishing liquid then passes directly through the free spaces between the collecting channel 3*d* and the edge faces 2*a* and 2*b* into lower containers of the stack. Due to the closed free space, the liquid does not pass to the outside. For this, it is essential that the lateral extension horizontal face 2*a* of the step-shaped edge of the side wall 2 outside of the lateral extension of the collecting channel 3*d*. In other words, the vertical face 2*b* of the step-shaped edge extends outside of the vertical wall 3*c* of the collecting channel 3*d*. In addition, the lower base plane 3*a* in the region of the collecting channel 3*d* must not rest on the horizontal face 2*a* of the lower container.

The lower, horizontal end face 2*f* of the projection 2*d* rests on the horizontal face 2*c* of the step-shaped edge. To this end, the lateral extension of the projection must be designed according to the lateral extension of the face 2*c* of the edge in that the two horizontal faces at least overlap. Preferably, the lateral extension of the horizontal face 2*f* of the projection lies entirely in the region of the uppermost, horizontal face of the step-shaped edge, in order to enable easier stacking.

What is claimed is:

1. A stackable container, comprising:

a base formed in one piece with a collecting channel and extending along an outer side of the base, said collecting channel having an outer wall; and side walls extending vertically upwards from the base and each having a lower end and an upper end, with the upper end of at least one of the side walls having a step-shaped edge defining an outer vertical face which extends upwards outside a lateral extension of the collecting channel, and defining an uppermost, horizontal end face, said at least one side wall having a plurality of through-openings which are distributed along the lower end of said at least one side wall and bear against the base, said through-openings configured to open on the outer side of said at least one side wall into the collecting channel, with the outer wail of the collecting channel sized to extend above a plane of an upper end of the through-openings, said at least one side wall having, on the outer side thereof, an outwardly directed projection which extends over the collecting channel and has a horizontal end face at a lower end thereof, with the horizontal end face of the projection having a position and lateral extension which at least overlap with a position and lateral extension of an uppermost, horizontal end face of a step-shaped edge of a side wall of a subjacent said container.

2. The stackable container of claim 1, wherein another one of said side walls in opposition to said at least one side wall has a same configuration as said at least one side wall.

3. The stackable container of claim 2, wherein the through-openings are arranged along a lower edge of the opposite ones of said side walls, with the collecting channel extending along the two opposite side walls.

4. The stackable container of claim 2, wherein the through-openings are arranged along a lower edge of the opposite ones of said side walls, with the collecting channel extending along all of the side walls.

5. The stackable container of claim 1, wherein all of the side walls have a same configuration with a plurality of through-openings arranged circumferentially along all of the side walls, with the collecting channel extending circumferentially along all of the side walls.

6. The stackable container of claim 1, wherein the base includes recesses arranged in line with the through-openings along edges of the base, said recesses configured to open into the collecting channel.

* * * * *